US012016371B2

(12) United States Patent
Capo

(10) Patent No.: US 12,016,371 B2
(45) Date of Patent: Jun. 25, 2024

(54) CASTING APPARATUS AND METHOD FOR THE PRODUCTION OF A CAST WEB OF A MATERIAL CONTAINING ALKALOIDS

(71) Applicant: PHILIP MORRIS PRODUCTS S.A., Neuchatel (CH)

(72) Inventor: Silvia Capo, Capaccio-Paestum (IT)

(73) Assignee: Philip Morris Products S.A., Neuchatel (CH)

( * ) Notice: Subject to any disclaimer, the term of this patent is extended or adjusted under 35 U.S.C. 154(b) by 585 days.

(21) Appl. No.: 17/251,358

(22) PCT Filed: Jun. 28, 2019

(86) PCT No.: PCT/EP2019/067489
§ 371 (c)(1),
(2) Date: Dec. 11, 2020

(87) PCT Pub. No.: WO2020/002686
PCT Pub. Date: Jan. 2, 2020

(65) Prior Publication Data

US 2021/0259298 A1 Aug. 26, 2021

(30) Foreign Application Priority Data

Jun. 29, 2018 (EP) ..... 18181031

(51) Int. Cl.
*A24B 3/14* (2006.01)
*A24B 15/14* (2006.01)
*A24C 5/01* (2020.01)

(52) U.S. Cl.
CPC ..... *A24B 3/14* (2013.01); *A24C 5/01* (2020.01); *A24B 15/14* (2013.01)

(58) Field of Classification Search
CPC ..... A24B 3/14; A24B 15/14; A24C 5/01
See application file for complete search history.

(56) References Cited

U.S. PATENT DOCUMENTS 2,734,513 A * 2/1956 Hungerford et al. .. A24B 15/14 264/129
3,259,136 A 7/1966 Jansson

FOREIGN PATENT DOCUMENTS

EP 0565360 10/1993
GB 1 013 303 12/1965
(Continued)

OTHER PUBLICATIONS

Search Report and Written Opinion for PCT/EP2019/067489 dated Sep. 24, 2019 (16 pages).
(Continued)

*Primary Examiner* — Christopher M Rodd
*Assistant Examiner* — Jennifer A Kessie
(74) *Attorney, Agent, or Firm* — Mueting Raasch Group

(57) ABSTRACT

The present invention relates to a casting apparatus (100) for the production of a cast sheet (10) of a material containing alkaloids, the casting apparatus comprising: •a casting box (1) adapted to contain a slurry (11) of the material containing alkaloids, the casting box having an aperture (16); •a movable support (7); •a casting roller (3) positioned at least partly within the casting box adapted to cast the slurry contained in the casting box onto the movable support so as to form the cast sheet; •wherein said casting roller faces the movable support forming a gap (I) therebetween, and wherein the movable support is located at least partly above the casting roller. The present invention also relates to a method for the production of a cast sheet of a material containing alkaloids.

15 Claims, 2 Drawing Sheets

(56) References Cited

FOREIGN PATENT DOCUMENTS

| | | |
|---|---|---|
| JP | S43-28080 B | 12/1943 |
| JP | S43-028080 | 11/1968 |
| WO | WO 2017/207161 | 12/2017 |

OTHER PUBLICATIONS

Office Action issued in Japan for Application No. 2020-568443 dated May 18, 2023. English translation included.

* cited by examiner

CASTING APPARATUS AND METHOD FOR THE PRODUCTION OF A CAST WEB OF A MATERIAL CONTAINING ALKALOIDS

This application is a U.S. National Stage Application of International Application No. PCT/EP2019/067489 filed Jun. 28, 2019, which was published in English on Jan. 2, 2020 as International Publication No. WO 2020/002686 A1. International Application No. PCT/EP2019/067489 claims priority to European Application No. 18181031.8 filed Jun. 29, 2018.

This invention relates to a casting apparatus and method for producing a cast web of a material containing alkaloids.

In particular, the material containing alkaloids is homogenized tobacco material, preferably used in an aerosol-generating article such as, for example, a cigarette or a "heat-not-burn" type tobacco containing product.

Today, in the manufacture of tobacco products, besides tobacco leaves, also homogenized tobacco material is used. This homogenized tobacco material is typically manufactured from parts of the tobacco plant that are less suited for the production of cut filler, like, for example, tobacco stems or tobacco dust. Typically, tobacco dust is created as a side product during the handling of the tobacco leaves during manufacture.

The most commonly used forms of homogenized tobacco material are reconstituted tobacco sheet and cast leaf (TCL is the acronym for tobacco cast leaf). The process to form homogenized tobacco material sheets commonly comprises a step in which tobacco dust and a binder are mixed to form a tobacco slurry. The slurry is then used to create a tobacco web, for example by casting a viscous slurry onto a moving metal belt to produce so called cast leaf. Alternatively, a slurry with low viscosity and high water content can be used to create reconstituted tobacco in a process that resembles paper-making. Once prepared, homogenized tobacco webs may be cut in a similar fashion as whole leaf tobacco to produce tobacco cut filler suitable for cigarettes and other smoking articles. A process for making such homogenized tobacco is for example disclosed in European Patent EP 0565360.

In a "heat-not-burn" aerosol-generating article, an aerosol-forming substrate is heated to a relatively low temperature, in order to form an aerosol but prevent combustion of the tobacco material. Further, the tobacco present in the homogenized tobacco material is typically the only tobacco, or includes the majority of the tobacco, present in the homogenized tobacco material of such a "heat-not burn" aerosol-generating article. This means that the aerosol composition that is generated by such a "heat-not burn" aerosol-generating article is substantially only based on the homogenized tobacco material. Therefore, it is important to have good control over the composition of the homogenized tobacco material, for the control for example, of the taste of the aerosol.

Due to variations in the physical properties of the slurry, for example, consistency, viscosity, fibre size, particle size, moisture or the age of the slurry, standard casting methods and apparatus may result in unintended variations in the application of the slurry onto a support during the casting of web of homogenized tobacco. A non-optimal casting method and apparatus may lead to inhomogeneity and defects of the cast web of homogenized tobacco.

Inhomogeneity in the homogenized tobacco web may lead to difficulties in subsequent handling of the homogenized tobacco web in the production of the aerosol-generating article. For example, inhomogeneity may lead to tearing of the web or even rupture of the web during manufacture or further processing of the web. This in turn could, for example, result in machine stops. Additionally, an inhomogeneous tobacco web may create unintended difference in the aerosol delivery between aerosol generating articles that are produced from the same homogenized tobacco web.

There is a need for a casting apparatus and method for the production of a cast web of a material containing alkaloids that is adapted to overcome, or at least considerably decrease, the above-mentioned issue.

The invention relates to a casting apparatus for the production of a cast sheet of a material containing alkaloids, the casting apparatus comprising: a casting box adapted to contain a slurry of the material containing alkaloids, the casting box having an aperture; a movable support; a casting roller positioned at least partly within the casting box adapted to cast the slurry contained in the casting box onto the movable support so as to form the cast sheet; wherein said casting roller faces the movable support forming a gap therebetween, and wherein the movable support is located at least partly above the casting roller.

A rotating roller provides a good control over the thickness of the cast sheet cast on the movable support. Variations of such a thickness are easy to obtain, modifying for example a width of the gap formed between movable support and casting roller.

Further, the presence of a roller in the casting box, which rotates to cast the sheet of material containing alkaloids onto the movable support, may create a mixing action on the slurry contained in the casting box. The mixing may allow the formation of a homogeneous slurry and, in turn, of a cast sheet having few defects.

As used herein, the terms "sheet" denotes a laminar element having a width and length substantially greater than the thickness thereof. The width of a sheet is preferably greater than about 10 millimeters, more preferably greater than about 20 millimeters or about 30 millimeters. Even more preferably, the width of the sheet is comprised between about 100 millimeters and about 300 millimeters. A continuous "sheet" is herein called "web".

As used herein, the term "movable support" denotes any means comprising a surface that can be moved in at least one longitudinal direction. The movable support may form a closed loop so as to provide an uninterrupted transporting ability in one direction. However, the movable support may be moved in a back and forth moving way as well. The movable support may include a conveyor belt. The movable support may be essentially flat and may show a structured or an unstructured surface. The movable support may show no openings in its surface or may show only orifices of such a size that they are impenetrable for the slurry deposited on it. The movable support may comprise a sheet-like movable and bendable band. The band may be made of a metallic material, including but not limited to steel, copper, iron alloys and copper alloys, or of a rubber material. The band may be made of a temperature-resistant material so that it can be heated to speed up the drying process of the slurry.

As used herein, the term "slurry" denotes a liquid-like, viscous or pasty material that may comprise an emulsion of different liquid-like, viscous or pasty material and that may contain a certain amount of solid-state particles, provided that the slurry still shows a liquid-like, viscous or pasty behaviour.

A "material containing alkaloids" is a material which contains one or more alkaloids. The alkaloids may comprise nicotine. The nicotine may be found, for example, in tobacco.

Alkaloids are a group of naturally occurring chemical compounds that mostly contain basic nitrogen atoms. This group also includes some related compounds with neutral and even weakly acidic properties. Some synthetic compounds of similar structure are also termed alkaloids. In addition to carbon, hydrogen and nitrogen, alkaloids may also contain oxygen, sulfur and, more rarely, other elements such as chlorine, bromine, and phosphorus.

Alkaloids are produced by a large variety of organisms including bacteria, fungi, plants, and animals. They can be purified from crude extracts of these organisms by acid-base extraction. Caffeine, nicotine, theobromine, atropine, tubocurarine are examples of alkaloids.

As used herein, the term "homogenised tobacco material" denotes material formed by agglomerating particulate tobacco, which contains the alkaloid nicotine. The material containing alkaloids can thus be a homogenized tobacco material.

The most commonly used forms of homogenized tobacco material is reconstituted tobacco sheet and cast leaf. The process to form homogenized tobacco material sheets commonly comprises a step in which tobacco dust and a binder, are mixed to form a slurry. The slurry is then used to create a tobacco web. For example by casting a viscous slurry onto a moving metal belt to produce so called cast leaf. Alternatively, a slurry with low viscosity and high water content can be used to create reconstituted tobacco in a process that resembles paper-making.

The homogenized tobacco sheet material can be also referred to as a reconstituted sheet material and formed using particulate tobacco (for example, reconstituted tobacco) or a tobacco particulate blend, a humectant and an aqueous solvent to form the tobacco composition. This tobacco composition may be then casted, extruded, rolled or pressed to form a sheet material from the tobacco composition. The sheet of tobacco can be formed utilizing a wet process, where tobacco fines are used to make a paper-like material; or a cast leaf process, where tobacco fines are mixed together with a binder material and cast onto a moving belt to form a sheet.

The homogenized tobacco sheet generally includes, in addition to the tobacco, a binder and an aerosol-former, such as guar and glycerin.

As used herein, the term "aerosol forming material" denotes a material that is capable of releasing volatile compounds upon heating to generate an aerosol. Tobacco, together with other compounds, may be classified as an aerosol forming material, particularly a sheet of homogenized tobacco comprising an aerosol former. An aerosol forming substrate may comprise or consist of an aerosol forming material. The homogenized tobacco sheet can be used as an aerosol forming material.

The slurry may comprise a number of different components or ingredients. These components may influence the properties of the cast web of material containing alkaloids. A first ingredient is a material containing alkaloids, for example in powder form. This material can be for example a tobacco powder blend, which preferably contains the majority of the tobacco present in the slurry. The tobacco powder blend is the source of the majority of tobacco in the homogenized tobacco material and thus gives the flavor to the final product, for example to an aerosol produced by heating the homogenized tobacco material. A cellulose pulp containing cellulose fibers is preferably added to the slurry in order to increase the tensile strength of the alkaloids material web, acting as a strengthening agent. A binder may be added. An aerosol-former may be added. Binder and aerosol-former are preferably added in order to enhance the tensile properties of the homogenized sheet and promote the formation of aerosol. Further, in order to reach a certain viscosity and moisture optimal for casting the web of material containing alkaloids, water may be added to the slurry.

The quantity of binder added to the slurry may be comprised between about 1 percent and about 5 percent in dry weight of the slurry. More preferably, it is comprised between about 2 percent and about 4 percent. The binder used in the slurry may be any of the gums or pectins described herein. The binder may ensure that the tobacco powder remains substantially dispersed throughout the homogenized tobacco web. Although any binder may be employed, preferred binders are natural pectins, such as fruit, citrus or tobacco pectins; guar gums, such as hydroxyethyl guar and hydroxypropyl guar; locust bean gums, such as hydroxyethyl and hydroxypropyl locust bean gum; alginate; starches, such as modified or derivitized starches; celluloses, such as methyl, ethyl, ethylhydroxymethyl and carboxymethyl cellulose; tamarind gum; dextran; pullalon; konjac flour; xanthan gum and the like. The particularly preferred binder for use in the present invention is guar.

The introduction of cellulose fibres in the slurry typically increases the tensile strength of the tobacco material web, acting as a strengthening agent. Therefore, adding cellulose fibres may increase the resilience of the homogenized tobacco material web. Cellulose fibres for including in a slurry for homogenized tobacco material are known in the art and include, but are not limited to: soft-wood fibres, hard wood fibres, jute fibres, flax fibres, tobacco fibres and combination thereof. In addition to pulping, the cellulose fibres might be subjected to suitable processes such as refining, mechanical pulping, chemical pulping, bleaching, sulphate pulping and combination thereof. Cellulose fibres may include tobacco stem materials, stalks or other tobacco plant material. Preferably, cellulose fibres such as wood fibres comprise a low lignin content. Alternatively fibres, such as vegetable fibres, may be used either with the above fibres or in the alternative, including hemp and bamboo. The length of cellulose fibres is advantageously between about 0.2 millimetres and about 4 millimetres. Preferably, the mean length per weight of the cellulose fibres is between about 1 millimetre and about 3 millimetres. Further, preferably, the amount of the cellulose fibres is comprised between about 1 percent and about 7 percent in dry weight basis of the total weight of the slurry (or homogenized tobacco sheet).

Suitable aerosol-formers for inclusion in slurry for homogenised tobacco material are known in the art and include, but are not limited to: monohydric alcohols like menthol, polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate.

Examples of preferred aerosol-formers are glycerine and propylene glycol.

The slurry may have an aerosol-former content of greater than about 5 percent on a dry weight basis. The slurry may have an aerosol former content of between about 5 percent and about 30 percent by weight on a dry weight basis. More preferably, the aerosol-former is comprised between about 10 percent to about 25 percent of dry weight of the slurry. More preferably, the aerosol-former is comprised between about 15 percent to about 25 percent of dry weight of the slurry.

The binder and the cellulose fibers are preferably included in a weight ratio comprised between about 1:7 and about 5:1. More preferably, the binder and the cellulose fibers are included in a weight ratio comprised between about 1:1 and about 3:1.

The binder and the aerosol-former are preferably included in a weight ratio comprised between about 1:30 and about 1:1. More preferably, the binder and the aerosol-former are included in a weight ratio comprised between about 1:20 and about 1:4.

Preferably, the alkaloid containing material is tobacco. The binder and the tobacco particles are preferably included in a weight ratio comprised between about 1:100 and about 1:10. More preferably, the binder and the tobacco particles are included in a weight ratio comprised between about 1:50 and about 1:15, even more preferably between about 1:30 and 1:20.

The aerosol-former and the tobacco particles are preferably included in a weight ratio comprised between about 1:20 and about 1:1. More preferably, the aerosol-former and the tobacco particles are included in a weight ratio comprised between about 1:6 and about 1:2.

The aerosol former and the cellulose fibres are preferably included in a weight ratio comprised between about 1:1 and about 30:1. More preferably, the aerosol-former and the cellulose fibres are included in a weight ratio comprised between about 5:1 and about 15:1.

The cellulose fibres and the tobacco particles are preferably included in a weight ratio comprised between about 1:100 and about 1:10. More preferably, the cellulose fibres and the tobacco particles are preferably included in a weight ratio comprised between about 1:50 and about 1:20.

The apparatus of the invention includes a casting box to contain the slurry and a movable support where the slurry is cast.

The slurry may reach the casting box from a different location. The casting box therefore might not be the place where the slurry is formed. For example, the slurry may be created in a silo or tank, from where it is transferred to the casting box via suitable piping. Preferably, the slurry is continuously supplied to the casting box while the slurry is cast onto the movable support to form a continuous web of material containing alkaloids. The silo and the casting box are thus preferably fluidly connected in order to allow the slurry flow from one to the other.

The casting-box is preferably box-shaped in order to form a container to house the slurry. Preferably, the casting box includes walls. Preferably, the walls in turn comprise sidewalls, more preferably including a first, second, third and fourth sidewall. The first and second sidewalls are advantageously facing each other, as well as the third and fourth sidewalls. The sidewalls are substantially vertical, or tilted with respect to a vertical plane. The casting box can be open on the upper side or might include a lid or a top wall. In addition, the casting box may include a bottom wall.

The walls of the casting box defines an inner volume of the casting box itself, that is, the walls delimit an inner volume of the casting box.

The casting box further includes an aperture in one of the walls, so that the box is not a completely closed container. The inner volume of the casting box is thus in contact with the outside. Due to the presence of the aperture, as inner volume of the casting box, the volume of a "theoretical" box where the area defined by the aperture is closed is considered. The demarcation line between the inner volume of the box and the outside is preferably made therefore considering the aperture closed by a wall. The aperture may be formed in more than one wall (for example, corner apertures, which are apertures formed at the corners of the box). Further, more than a single aperture might be present.

Inside the casting box, a casting roller is positioned. The mounting of the casting roller inside the casting box is such that the roller can rotate around a rotation axis, called in the following first rotation axis. Preferably, the casting roller defines a first and a second opposite longitudinal ends and the opposite longitudinal ends are attached to opposite sidewalls of the casting box, for example, one end is attached to the first sidewall and the opposite end is attached to the second sidewall.

Preferably, the casting roller is substantially cylindrical. The casting roller may be made of metal, such as stainless steel or aluminum. Alternatively, it may include plastic material or rubber. It has preferably a major dimension that corresponds to the longitudinal dimension, which in turn preferably corresponds to the direction of the axis of the cylinder.

Preferably, the casting roller is rotated around its rotational axis, called first rotational axis, by a motor. The longitudinal direction of the casting roller preferably is also parallel or coincide with the first rotation axis. The casting roller is thus advantageously driven in rotation and its rotational speed can be adjusted.

Preferably, the first rotation axis is substantially horizontal, that is, it is part of a horizontal plane. Further, preferably the distance between the first rotation axis and a bottom wall of the casting box is constant along the longitudinal length of the casting roller. A longitudinal length of the casting roller is the length of the roller between his first and his second opposite longitudinal ends.

Further, preferably a height at which the casting roller is mounted in the casting box is such that at least a part of the casting roller is in contact with the slurry. The casting roller is preferably partly immersed in the slurry, so that by a rotation of the casting roller, an outer surface of the casting roller becomes covered by a layer of slurry. A height at which the casting roller is mounted is defined as the distance along the vertical Z axis between the first rotation axis and a reference horizontal plane. If the distance is not constant along the casting roller length, then an average of the distances is taken as the height. However, it is not always needed that the casting roller is in contact with the slurry present inside the casting box, because slurry can be transferred to the casting roller from other elements, such additional rollers. Therefore the wording "the casting roller being apt to cast the slurry contained in the casting box" means that the casting roller casts the slurry that is present at a certain moment in time in the casting box, but it does not have to be taken directly by the casting roller from the casting box and cast, it can be transferred to the casting roller from the casting box by additional elements.

The relative mounting of the casting roller and of the movable support is such that the two face each other. A gap is preferably formed between the casting roller and the movable support. Preferably, this gap is substantially equal to a thickness of a layer of slurry.

Further, preferably, the movable support is at least partially located above the casting roller. The wording "at least partly located above" is synonym of "at least partially located above" and means that the coordinate along a vertical axis (ordinate) of the casting roller, as defined by the location of its first rotational axis, and the coordinate (ordinate) along the same vertical axis of the location of the line where the slurry is cast onto the movable support, that is, the line of contact between slurry and movable support, are at two different heights, and that the height of the line of contact is higher that the height of the first rotational axis of the casting roller. Thus, if $Z_{axis}$ is the coordinate of the first rotational axis of the casting roller along a vertical axis and $Z_{contact}$ the coordinate of the contact line between slurry on the casting roller and movable support along the same vertical axis, then—assuming that both coordinates are positive -, $Z_{contact}>Z_{axis}$ (if the coordinates are not positive, a frame of reference can be selected so that they are positive and increasing towards higher heights). In the above, it has been considered that the coordinate $Z_{axis}$ of the first rotational axis remains constant along its extension. If this is not true, that is, if the first rotational axis is not horizontal, then $Z_{axis}$ is the average of all $Z_{axis,\ i}$ of all points i of the first rotational axis along its extension. In the same way, it has been considered that the coordinate $Z_{contact}$ of the contact line remains constant along its extension. If this is not true, that is, if the contact line is not horizontal, then $Z_{contact}$ is the average of all $Z_{contact,\ i}$ of all points i of the contact line along its extension.

In a configuration, "partly located above" might mean that, on a top view, the movable support and the casting roller at least partially overlap.

The advantage of this configuration is that application of the slurry may be more uniform. The slurry does not "fall" on the movable support but it is applied on the movable support in a controlled manner.

Advantageously, when the casting roller is driven into rotation, the slurry layer attaches itself to the outer surface of the casting roller due to its "sticky" properties. Due to the fact that the gap present between casting roller and movable support is preferably smaller than or equal to the thickness of the layer, the layer of slurry is automatically transferred to the movable support by contact. In this way, a web of material containing alkaloids is casted.

Preferably, the tangential speed of the casting roller is similar or identical to the tangential speed of the movable support. Therefore, the ratio between the two tangential speeds at the gap defined between the casting roller and the movable support is preferably comprised between about 0.9 and about 1.1, more preferably it is of about 1.

The width of the gap depends, among others, on the parameters of the slurry, such as its viscosity. The width of the gap can be easily controlled or modified changing the position of the movable support or of the casting roller and therefore an easy control on the thickness of the cast web is obtained.

Preferably the gap is uniform in width, that is, the width of the gap remains constant for all the longitudinal extension of the casting roller.

The gap is preferably equal to the minimum distance between the casting roller and the movable support.

The movable support might be for example a movable belt. The movable support is preferably positioned facing the aperture formed in the casting box or adjacent to the aperture. The material in which the movable support is made is preferably suitable to avoid or to minimize gluing of the slurry on it when casted.

The movable support is positioned at least in part outside of the casting box to transport the cast sheet away from the casting box. More preferably, all the movable support is located outside the casting box. Preferably, the gap is also located outside the casting box. The casting roller and the movable support face each other where the aperture is, which is the location where the inner volume of the casting box can enter into contact with the outside.

In the rotational movement to transfer the slurry from the casting box to the movable support, the casting roller also mixes the slurry. The "slurry waves" and agitation caused by the rotation may help mixing the slurry inside the casting box.

The mixing caused by the casting roller might be the only mixing present in the casting box, or other elements for mixing can be present, such as agitators, fins or similar, inside the casting box.

The mixing helps to homogenize the slurry inside the casting box so that the ingredients forming the slurry and the slurry parameters (such as for example temperature, viscosity, and others) may become evenly distributed inside the casting box. The slurry may be very dense, highly viscous and can be considered as a non-Newtonian fluid. Non-homogeneities in the slurry remain often local and they "propagate" with difficulty. Non-homogeneity in the slurry turns in a non-homogeneity in the cast sheet, causing a non-reproducibility of the final product. An improvement in the slurry mixing may be therefore beneficial for the characteristics of the final product.

Further, only a single element is needed to perform two functions: the casting roller mixes and casts at the same time. No additional components are needed.

Preferably, the casting roller has a first portion contained within the casting box and a second portion protruding from the aperture. Advantageously, when the casting roller is mounded in the casting box, the casting roller has a first portion which is located within the casting box, that is, in the casting box inner volume, while a second portion is located outside. In order to be located outside the inner volume of the casting box, the second portion of the casting roller protrudes from the aperture. Preferably, the size of the aperture is wide enough to allow the second portion of the casting roller to protrude from it.

Preferably, the aperture in the casting box is located in an upper portion of the casting box. The casting box has a given height along a Z direction. The "upper portion" of the casting box is the part of the casting box located above a horizontal plane passing through the median of the height of the casting box. If more than a height can be defined in the casting box, an average of all heights is considered before taking the median.

Preferably, the apparatus includes a transfer roller located within the casting box apt to transfer slurry from the casting box to the casting roller. A second roller is advantageously positioned within the casting box, that is, in the inner volume of the casting box. Preferably, the transfer roller may be connected to the casting box in the same way as the casting roller. For example, the transfer roller may define a first and a second opposite longitudinal ends and the opposite ends are attached to opposite side walls of the casting box, for example the same opposite walls to which the casting roller is attached to.

The mounting of the transfer roller inside the casting box is such that the roller can rotate around a rotation axis, called in the following second rotation axis. The transfer roller is preferably substantially cylindrical and the second rotational axis corresponds to the longitudinal axis of the cylinder.

Preferably, a second gap is formed between the casting roller and the transfer roller. The second gap is preferably equal to the minimum distance between the casting roller and the transfer roller. Preferably, the width of the second gap is constant along the longitudinal extension of the casting and transfer rollers.

The transfer roller is also preferably driven in rotation by a motor. Preferably, the tangential speed of the casting roller is similar or identical to the tangential speed of the transfer roller. Therefore, the ratio between the two tangential speeds at the second gap defined between the casting roller and the transfer roller is preferably comprised between about 0.9 and about 1.1, more preferably it is of about 1.

Preferably, the diameter of the transfer roller is bigger than the diameter of the casting roller. In this configuration, the transfer roller "moves" a big volume of slurry while it rotates, increasing the slurry mixing.

Alternatively, the diameter of the transfer roller is smaller than the diameter of the casting roller. In this configuration, the smaller transfer roller preferably has a higher angular velocity than the casting roller in order to achieve the substantially similar tangential speed. A fast transfer roller may create "slurry waves" for an improved mixing.

The transfer roller preferably transfers the slurry from the casting box to the casting roller. Preferably, the transfer roller is at least partially immersed in the slurry. More preferably, it is completely submerged by the slurry. In this configuration with two rollers, there is no need for the casting roller to be submerged by the slurry in the casting box, the transfer roller transfers the slurry on the surface of the casting roller. The casting roller therefore may be located completely above the slurry level in the casting box.

Preferably, the ratio between the volume of the casting roller submerged by the slurry over the total volume of the casting roller is smaller than the same ratio when the transfer roller is considered. The slurry preferably covers the transfer roller more than the casting roller. Preferably, the height of the first rotational axis is higher that the height of the second rotational axis. Thus, if $Z_{axis}$ is the coordinate of the first rotational axis of the casting roller along a vertical axis and $Z_{axis2}$ the coordinate of the second rotational axis of the transfer roller along the same vertical axis, then—assuming that both coordinates are positive (if the coordinates are not positive, a frame of reference can be selected so that they are positive and increasing towards higher heights))—, $Z_{axis}>Z_{axis2}$. In the above, it has been considered that the coordinate of the first and second rotational axis remains constant along their extension. If this is not true, that is, if the first rotational axis is not horizontal, then $Z_{axis}$ is the average of all $Z_{axis}$, of all points i of the first rotational axis along its extension. In the same way, it has been considered that the coordinate of the second rotational axis remains constant along its extension. If this is not true, that is, if the second rotational axis is not horizontal, then $Z_{axis2}$ is the average of all $Z_{axis2,\ i}$ of all points i of the second rotational axis along its extension.

By performing rotational movements to transfer the slurry from the casting box to the casting roller, the transfer roller also mixes the slurry. There is therefore at least a double mixing in the casting box: the one performed by the casting roller transferring the slurry from its surface to the movable support and then preferably also the one performed by the transfer roller transferring slurry from its surface to the casting roller. The mixing of the transfer roller can be even more effective than that of the casting roller, because preferably the transfer roller is in contact with more slurry than the casting roller so it can impart a motion to a bigger slurry's volume.

Further, the presence of two rollers (transfer and casting) may improve the control on the thickness of the cast web. The slurry in this example has to pass through two gaps, the width of which can be easily and precisely selected. The slurry cast on the movable support therefore has a controlled size.

Preferably, the casting roller and the transfer roller defines a first and a second rotation axis, the first and second rotation axis being parallel to each other. Preferably, the first and second rotation axes are parallel so that the distance between the casting and transfer roller stay constant along their longitudinal extension, forming a substantially uniform layer of slurry.

Preferably, the casting box includes sidewalls and an inlet for the slurry, the inlet for the slurry being formed in one of the sidewalls. An insertion of slurry from one of the sidewalls, instead—for example—of an insertion from above, may further improve the homogeneity of the slurry because it minimizes or limits the formation of air bubbles inside the slurry itself. The insertion of additional slurry in the casting box, via an inlet, is preferably performed below a given level of slurry in the casting box. Preferably, the given level of slurry in the casting box is kept substantially constant at a specified height or within a specified heights' range. Therefore, advantageously, while casting, there is a continuous flow of new slurry which is brought into the casting box via suitable piping. If the slurry is added in such a way that it falls onto the casting box, the slurry falling through air may incorporate air bubbles, which may cause defects in the cast web. With an inlet positioned in a sidewall below the given slurry level, air bubbles are difficult to form.

Preferably, the inlet is positioned below a height of the first rotation axis of the casting roller in a vertical direction. Preferably, the height of the invelt is lower that the height of the first rotational axis. Thus, if $Z_{axis}$ is the coordinate of the first rotational axis of the casting roller along a vertical axis and $Z_{inlet}$ the coordinate of the inlet along the same vertical axis, then—assuming that both coordinates are positive (if the coordinates are not positive, a frame of reference can be selected so that they are positive and increasing towards higher heights))—, $Z_{axis}>Z_{inlet}$. In the above, it has been considered that the coordinate of the first rotational axis and inlet remain constant along their extension. If this is not true, that is, if the first rotational axis is not horizontal, then Z axis is the average of all $Z_{axis,\ i}$ of all points i of the first rotational axis along its extension. In the same way, it has been considered that the coordinate of the inlet remains constant along its extension. If this is not true, that is, if the inlet is not horizontal, then $Z_{inlet}$ is the average of all $Z_{inlet,\ i}$ of all points i of the inlet along its extension.

Preferably, the inlet is positioned at a rather "low" height because it is preferably located below the slurry level in the casting box. More preferably, the inlet is positioned below a height of the first and second rotation axis of the transfer roller in a vertical direction. The height of the second rotation axis of the transfer roller is preferably smaller than the height of the first rotation axis.

Preferably, the movable support includes a drum and a belt, the drum defining a third rotational axis parallel to a first rotation axis of the casting roller. With this arrangement, a constant gap between the casting roller and the movable support can be obtained.

Preferably, a distance between the first and second rotation axis is comprised between about 320 millimetres and about 1100 millimetres. More preferably, it is comprised between about 390 millimetres and about 780 millimetres.

Preferably, a distance between a vertical plane containing the first rotation axis and a vertical plane containing the third rotation axes is comprised between about 800 millimetres and about 1700 millimetres. More preferably, it is comprised between about 1000 millimetres and about 1500 millimetres.

Preferably, a distance between a vertical plane containing the first rotation axis and a vertical plane containing the second rotation axes is comprised between about 200 millimetres and about 700 millimetres. More preferably, it is comprised between about 250 millimetres and about 500 millimetres.

Preferably, a distance between a horizontal plane containing the second rotation axis and a horizontal plane containing the third rotation axes is comprised between about 1200 millimetres and about 2500 millimetres. More preferably, it is comprised between about 1500 millimetres and about 2000 millimetres.

Preferably, a distance between a horizontal plane containing the first rotation axis and a horizontal plane containing the second rotation axes is comprised between about 250 millimetres and about 850 millimetres. More preferably, it is comprised between about 300 millimetres and about 600 millimetres.

Preferably, the diameter of the casting roller is comprised between about 150 millimetres and about 1300 millimetres. More preferably, it is comprised between about 500 millimetres and about 1100 millimetres. Preferably, the diameter of the transfer roller is comprised between about 250 millimetres and about 1700 millimetres. More preferably, it is comprised between about 600 millimetres and about 1300 millimetres.

Preferably, the gap present between the casting roller and the movable support, where with gap the shortest distance between the two is indicated, is comprised between about 0.01 millimetres and about 5 millimetres. More preferably it is comprised between about 0.01 millimetres and about 2 millimetres. More preferably, it is comprised between about 0.5 and about 1.5 millimetres.

Preferably, the gap present between the casting roller and the transfer roller, where with gap the shortest distance between the two is indicated, is comprised between about 0.1 millimetres and about 15 millimetres. More preferably it is comprised between about 0.3 millimetres and about 7 millimetres. More preferably, it is comprised between about 0.5 millimetres and about 1.5 millimetres.

Preferably, the movable support is positioned at least partly above the casting roller. The respective arrangements of casting roller and movable support is preferably such as to transfer the slurry from casting roller to movable support in the optimal way.

The invention also relates to a method for the production of a cast sheet of a material containing alkaloids, the method comprising: providing a casting box having an aperture; providing a casting roller positioned at least partly within the casting box; providing a movable support facing the casting roller; introducing the slurry in the casting box up to a slurry level, wherein a portion of the casting roller is located above the slurry level; and rotating the casting roller so that slurry is cast onto the movable support.

The advantages of the method of the invention have been already detailed in discussing the apparatus. In addition, the slurry is introduced in the casting box so that a slurry level is reached. Preferably, the slurry level is kept constant or within a range. The casting roller is preferably at least for a portion positioned outside the slurry, so that it is above the slurry level. The casting roller could also be completely above the slurry level.

The advantage of this configuration is that application of the slurry from the casting roller to the movable support is not influenced, or the influence is minimized, by possible changes in the pressure value present within the casting box, for example when the quantity of slurry varies.

Preferably, the method includes providing a transfer roller inside the casting box; and rotating the transfer roller to mix the slurry in the casting box. A double mixing caused by the rotation of both the casting roller and the transfer roller is thus present, which may homogenize the slurry even further, allowing a better control on the thickness of the cast sheet as well.

Preferably, the method includes rotating the transfer roller to transfer the slurry from the casting box to the casting roller. The slurry is preferably first transferred from the casting box to the transfer roller, then from the transfer roller to the casting roller and finally from the casting roller to the movable support. Additional rollers may be present as well.

Preferably, the method includes moving the movable support at a speed comprised between about 5 meters/minute and about 50 meters/minute. The movable support constantly moves during casting to create a web of material including alkaloids. The selected speed range is a compromise between the requirements for a fast production and the requirements for a formation of a smooth homogeneous cast web.

Preferably, the step of introducing the slurry inside the casting box includes introducing the slurry below a slurry level in the casting box. The slurry is introduced in the casting box preferably till a given slurry level is reached. Preferably, this given level is maintained within a selected range. The slurry is removed continuously from the casting box in order to cast the sheet of material containing alkaloids, so in order to maintain the slurry level within the selected range, slurry needs to be added in the casting box. Preferably, this addition takes place below the slurry level, that is, the entrance of additional slurry is positioned at a height, which is lower than the height defined by the slurry level in the casting box. An introduction of slurry below the slurry level may allow a reduction of the number of air bubbles in the slurry.

Preferably, the step of introducing the slurry inside the casting box includes introducing the slurry in the casting box along a feeding direction, the feeding direction forming an angle with a horizontal plane comprised between about −45 degrees and about +45 degrees. Preferably, the introduction of the slurry in the casting box takes place on a sidewall of the same. Preferably, the slurry is introduced with a given pressure. Thanks to a feeding direction which is not vertical, the formation of air bubbles inside the casting box is reduced or minimized; furthermore the slurry contained in the casting box is not affected by the potential energy of the falling slurry and this entails a more homogeneous (content and thickness) cast leaf due to a constant pressure condition within the casting box.

A substantially horizontal feeding of the slurry may avoid "gravity effect" and related flow variations during slurry feeding.

Preferably, the cast sheet of a material containing alkaloids includes a homogenized tobacco sheet.

Preferably, the step of providing a movable support includes: providing a movable support positioned at least partly above the casting roller, Preferably, the invention also relates to a casting apparatus for the production of a cast sheet, the casting apparatus comprising: a casting box adapted to contain a slurry, the casting box having an aperture; a movable support; a casting roller positioned at least partly within the casting box apt to cast the slurry contained in the casting box onto the movable support so as to form the cast sheet; wherein said casting roller faces the movable support forming a gap therebetween.

Preferably, the invention also relates to a method for the production of a cast sheet, the method comprising: providing a casting box having an aperture; providing a casting roller positioned at least partly within the casting box; providing a movable support facing the casting roller; introducing the slurry in the casting box up to a given level; and rotating the casting roller so that slurry is cast onto the movable support.

Further advantages of the invention will become apparent from the detailed description thereof with no-limiting reference to the appended drawings wherein.

Figure 1:
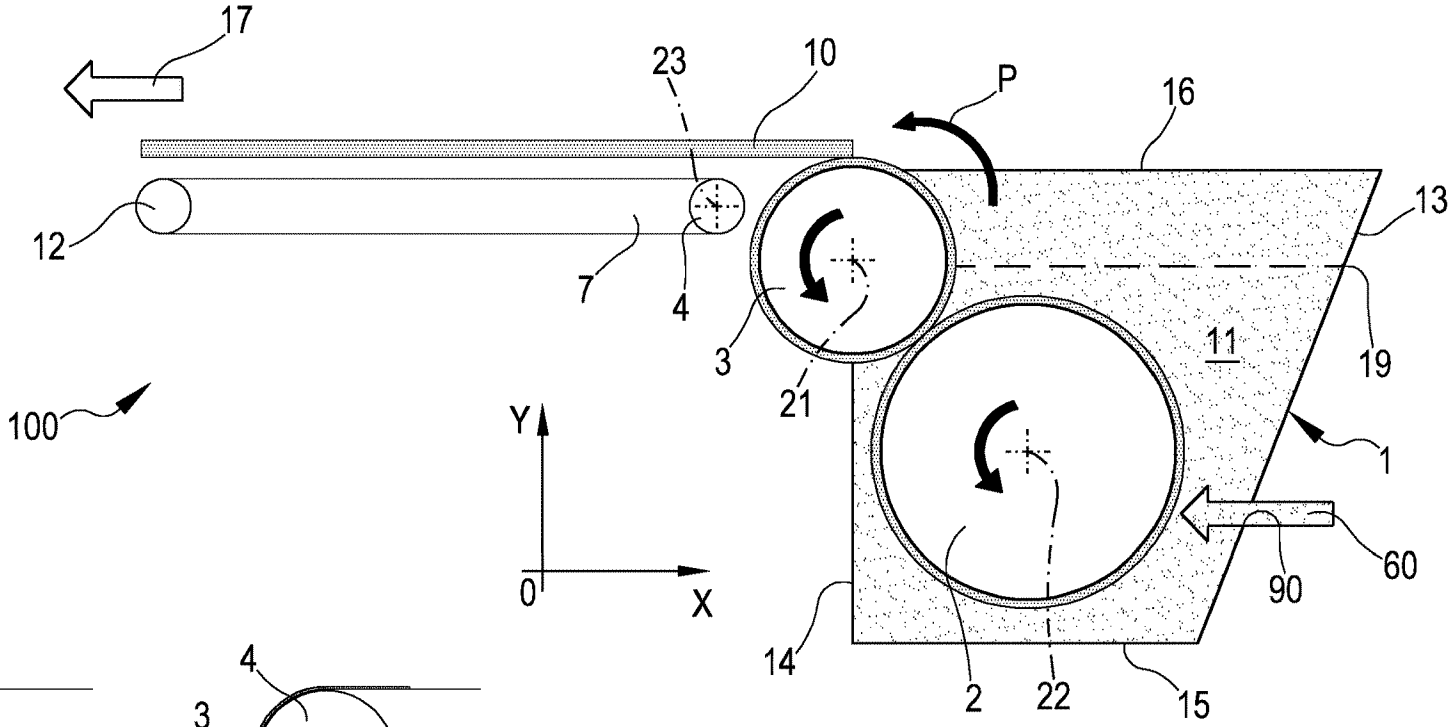
FIG. 1 is a schematic lateral section view of an apparatus for the production of a web of a material containing alkaloids.
Figure 3B:
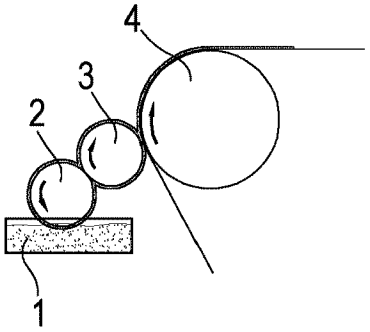
Figure 3A:
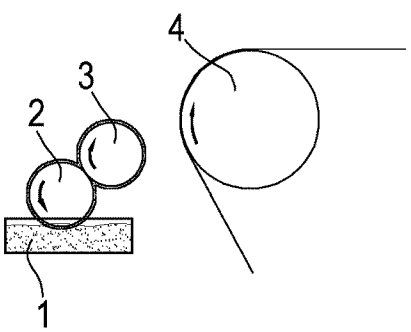

FIGS. 3*a* and 3*b* are schematic views of the apparatus of FIG. 1 in two operative conditions.

Figure 2:
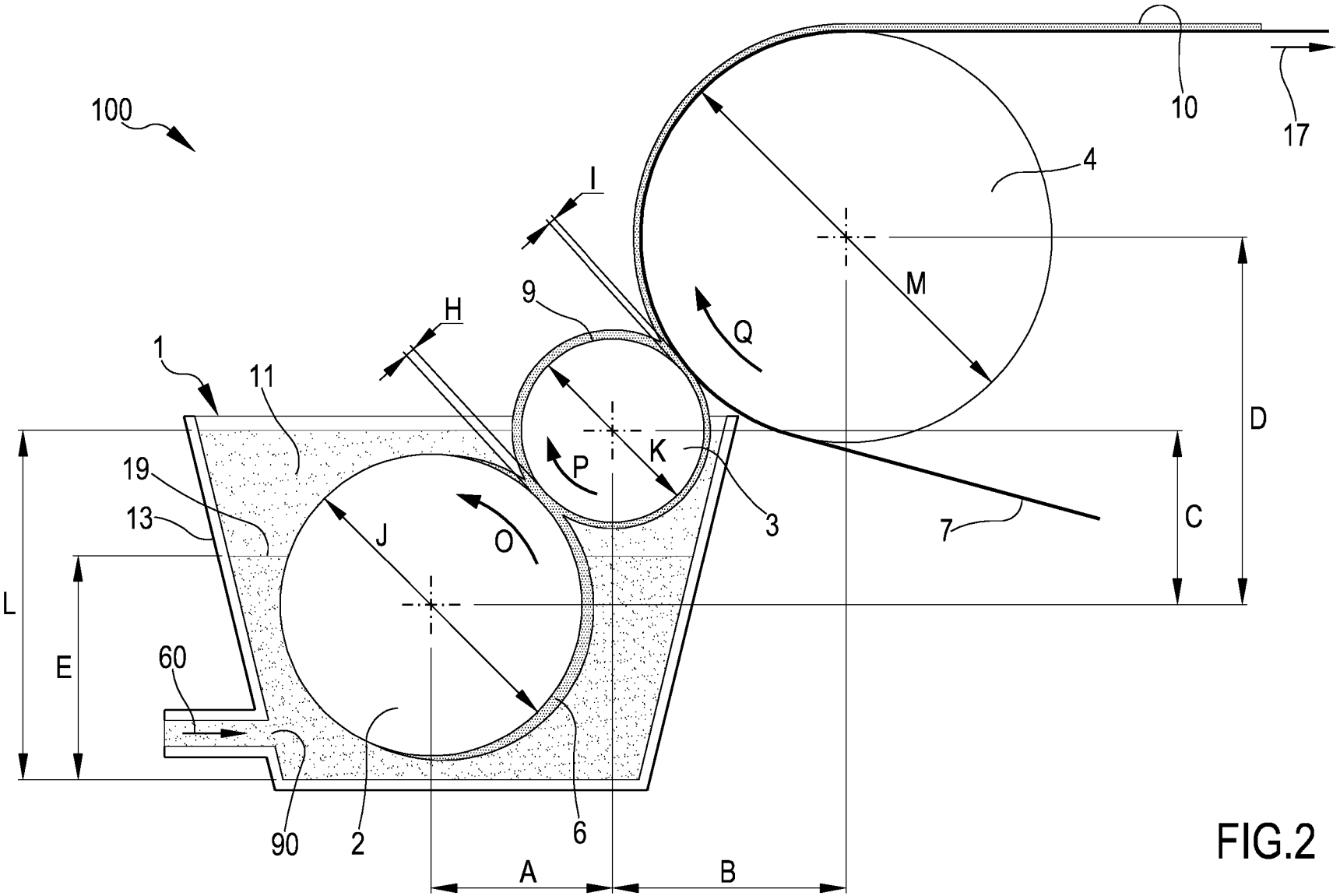
FIG. 2 is a detail in enlarged view of the apparatus of FIG. 1.

FIGS. 1 and 2 show an apparatus 100 for the production of a web 10 of homogenized tobacco material according to the invention.

The apparatus 100 comprises a casting box 10 containing slurry 11 and a movable support 7, wherein a casting roller 3—associated to the casting box 1—casts the slurry 11 contained in the casting box 1 onto the movable support 7 so as to form the cast sheet or web 10 of homogenized tobacco material.

The casting box 1 comprises side walls including a first and a second opposite walls 13, 14. The casting box 1 is generally defined by four side walls, i.e. the first and second opposite walls 13, 14 and a third and a fourth opposite walls (not shown in the figures), which connect the first and second opposite walls 13, 14.

Further, casting box 1 includes a bottom wall 15. It also includes an aperture 16, in this case coinciding with a top of the casting box and a portion of the wall 14. The aperture 16 is positioned in proximity of the movable support 7.

The movable support 7 comprises a continuous stainless steel belt including a drum assembly. Preferably, the steel belt is wound around a pair of opposite drums 4, 12. The slurry is cast on the steel belt—at the drum 4—through the casting roller 3, which creates a continuous sheet 10 of homogenized tobacco material.

The casted slurry 10 is driven by the movable support 7 along a casting direction indicated with an arrow 17 in FIG. 1 and enters a heating unit (not shown in the figures), where it is progressively heated and homogeneously dried.

The incoming slurry 11 is introduced into the casting box 1 from an inlet 90, in particular the end of a pipe 60, connected to the side wall 13 of the casting box 1 where it forms an opening, which puts this incoming slurry 11 close to the bottom of the casting box 1.

Slurry 11 from buffer tanks (not shown in the drawings) is transferred into the casting box 1 usually by means of a pump (not shown in the drawings). Preferably, the pump comprises a control (not visible in the drawing) of flow rate to control the amount of slurry 11 introduced in the casting box 1. The pump is advantageously designed to ensure that slurry transfer times are kept to the minimum necessary.

The amount of slurry 11 in the casting box 1 has a pre-determined level, which is preferably kept substantially constant or within a given range. In order to keep the amount of slurry 11 substantially at the same level, the pump controls the flow of slurry 11 to the casting box 1. The predetermined level of slurry is indicated in FIGS. 1 and 2 with a dashed line 19.

The casting roller 3 is associated to the casting box 1 in order to cast the slurry. The casting roller 3 has a dominant dimension which is its longitudinal width. The casting roller defines a first rotation axis 21 (indicated with a cross in FIG. 1) which corresponds to its longitudinal direction. Preferably first rotation axis 21 is horizontal and more preferably perpendicular to the casting direction 17.

The casting roller 3 is attached in a rotatable manner to the casting box 1 preferably by means of its ends to two opposite side walls. Further, the casting roller 3 protrudes partially from aperture 16 and faces movable support 7 (see in detail FIG. 2). The diameter of the casting roller 3 is indicated with K and its direction of rotation with P.

Between the casting roller 3 and the steel belt of movable support 7 a gap is present, indicated with I in the drawings, the dimensions of which determine—among others—the thickness of the cast web 10 of homogenized tobacco material. Casting roller 3 and belt 7 face each other at the aperture 16 and the belt is partially positioned above the casting roller 3. The drum 4 having diameter M transporting belt 7 preferably rotates in the same direction Q as the casting roller 3 (see direction of arrows P and Q in FIG. 2). Drum 4 preferably defines a third rotational axis 23, depicted as a cross in FIG. 1.

The casting box 1 preferably comprises also a second roller, transfer roller 2. Transfer roller 2 preferably has a diameter J bigger than diameter K of the casting roller 3. Preferably, transfer roller 2 is cylindrical and defines a second rotation axis 22 (indicated with a cross in FIG. 1) parallel to first rotation axis 21. The transfer roller 2 is attached in a rotatable manner to two opposite side walls of the casting box 1, preferably by means of its longitudinal ends. Further, the transfer roller 2 is preferably located within casting box 1 in its entirety and it is submerged by slurry 11 at least in part. The rotation direction O of transfer roller 2 is opposite to direction P or Q of casting roller 3 and drum 4.

Between the casting roller 2 and the transfer roller 3 a gap H is formed.

Further preferred technical details of the casting box 1 are listed in the following Table 1. In Table 1 all values are given in millimetres (mm).

TABLE 1

| | Min (mm) | Max (mm) | Min (mm-more preferable) | Max (mm-more preferable) |
|---|---|---|---|---|
| A | 200 | 700 | 250 | 500 |
| B | 800 | 1700 | 1000 | 1500 |
| C | 250 | 850 | 300 | 600 |
| D | 1200 | 2500 | 1500 | 2000 |
| E | 100 | 1000 | 200 | 600 |
| H | 0.10 | 15.00 | 0.30 | 7.00 |
| I | 0.01 | 5.00 | 0.01 | 2.00 |
| J | 250 | 1700 | 600 | 1300 |
| K | 150 | 1300 | 500 | 1100 |
| L | 300 | 2000 | 500 | 1300 |
| M | 750 | 3000 | 1500 | 2500 |

Preferably, a distance A along a horizontal axis between the first and second rotational axis 21, 22, is comprised between about 200 millimeters and about 700 millimeters. More preferably, A is comprised between about 250 millimeters and about 500 millimeters.

Preferably, a distance B along a horizontal axis between the first and third rotational axis 21, 23, is comprised between about 800 millimeters and about 1700 millimeters. More preferably, B is comprised between about 1000 millimeters and about 1500 millimeters.

Preferably, a distance C along a vertical axis between the first and second rotational axis 21, 22, is comprised between about 250 millimeters and about 850 millimeters. More preferably, C is comprised between about 300 millimeters and about 600 millimeters.

Therefore the distance between the first and second rotational axis is equal to $$\text{Distance}=1/A^2+C^2$$

which is preferably comprised between about 320 millimeters and about 1101 millimeters.

Preferably, a distance D along a vertical axis between the first and third rotational axis 21, 23, is comprised between about 1200 millimeters and about 2500 millimeters. More preferably, D is comprised between about 1500 millimeters and about 2000 millimeters.

Preferably, the slurry level E along a vertical axis from a bottom of the casting box is comprised between about 100 millimeters and about 1000 millimeters. More preferably, E is comprised between about 200 millimeters and about 600 millimeters.

Preferably, the gap H between the casting roller 2 and the transfer roller 3 is comprised between about 0.10 millimeters and about 15 millimeters. More preferably, H is comprised between about 0.30 millimeters and about 7 millimeters.

Preferably, the gap I between the casting roller 2 and the drum 4 is comprised between about 0.01 millimeters and about 5 millimeters. More preferably, I is comprised between about 0.01 millimeters and about 2 millimeters.

Preferably, the diameter J of the transfer roller 3 is comprised between about 250 millimeters and about 1700 millimeters. More preferably, J is comprised between about 600 millimeters and about 1300 millimeters.

Preferably, the diameter K of the casting roller 2 is comprised between about 150 millimeters and about 1300 millimeters. More preferably, K is comprised between about 500 millimeters and about 1100 millimeters.

Preferably, the diameter M of the drum 4 is comprised between about 750 millimeters and about 3000 millimeters. More preferably, M is comprised between about 1500 millimeters and about 2500 millimeters.

Preferably, the height L of the casting box is comprised between about 300 millimeters and about 2000 millimeters. More preferably, L is comprised between about 500 millimeters and about 1300 millimeters.

In the functioning of the apparatus 100, the slurry 11 is supplied to the casting box 1 at the inlet 90, which is positioned on a side wall 13 at a bottom part of casting box 1. Slurry reaches a given level 19. The transfer roller 3 is partially in contact with the slurry 11 in the casting box when it reaches level 19 and, due to its rotation, it covers its outer surface with a film or layer 6 of slurry 11, so that there is a slurry coating in roller 2 before its first transfer to casting roller 3. The slurry is then transferred to casting roller 3 due to the contact between layer 6 on transfer roller 3 and the surface of casting roller 2, and a slurry coating layer 9 is formed on the surface of casting roller 2 before its final transfer to conveying belt 7.

Casting roller 2 rotates around axis 21 and the slurry layer 9 touches belt of movable support 7. This causes a transfer of the slurry from casting roller 3 to belt 7, where the slurry coating forms the cast web 10.

The web is then preferably dried and wound up into bobbins for storage (not shown in the figures). These bobbins are later unwound and used to create the tobacco component for aerosol generating articles.

As visible in FIG. 3*a*, 3*b*, preferably first the casting box 1 is mounted and the rollers 2,3 are arranged in it, and then the movable support 7 is moved close to the casting box in order to start the casting.

The invention claimed is:

1. A casting apparatus for production of a cast sheet of a material containing alkaloids, the casting apparatus comprising:

a casting box adapted to contain a slurry of the material containing alkaloids, the casting box having an aperture;

a movable support;

a casting roller positioned at least partly within the casting box adapted to cast the slurry contained in the casting box onto the movable support so as to form the cast sheet;

wherein said casting roller faces the movable support forming a gap therebetween, and wherein the movable support is located at least partly above the casting roller.

2. The casting apparatus according to claim 1, including a transfer roller located within the casting box adapted to transfer slurry from the casting box to the casting roller.

3. The casting apparatus according to claim 2, wherein the casting roller and the transfer roller defines a first and a second rotation axis, the first and second rotation axis being parallel to each other.

4. The casting apparatus according to claim 3, wherein the casting box includes side walls and an inlet for the slurry, the inlet for the slurry being formed in one of the side walls.

5. The casting apparatus according to claim 4, wherein the inlet is positioned below a height of the first rotation axis of the casting roller in a vertical direction.

6. The casting apparatus according to claim 1, wherein the movable support includes a drum and a belt, the drum defining a third rotational axis parallel to a first rotation axis of the casting roller.

7. The casting apparatus according to claim 3, wherein a distance between the first and second rotation axis is comprised between about 320 millimetres and about 1100 millimetres.

8. The casting apparatus according to claim 1, wherein the gap present between the casting roller and the movable support is comprised between about 0.01 millimetres and about 5 millimetres.

9. A method for production of a cast sheet of a material containing alkaloids, the method comprising:

providing a casting box having an aperture;

providing a casting roller positioned at least partly within the casting box;

providing a movable support facing the casting roller;

introducing a slurry in the casting box up to a slurry level, wherein a portion of the casting roller is located above the slurry level; and rotating the casting roller so that slurry is cast onto the movable support.

10. The method according to claim 9, including:

providing a transfer roller inside the casting box; and rotating the transfer roller to mix the slurry in the casting box.

11. The method according to claim 10, including:

rotating the transfer roller to transfer the slurry from the casting box to the casting roller.

12. The method according to claim 9, including:

moving the movable support at a speed comprised between about 5 meters/minute and about 50 meters/minute.

13. The method according to claim 9, wherein the step of introducing the slurry inside the casting box includes:

introducing the slurry in the casting box along a feeding direction, the feeding direction forming an angle with a horizontal plane comprised between about −45 degrees and about +45 degrees.

14. The method according to claim 9, wherein the cast sheet of a material containing alkaloids includes a homogenized tobacco sheet.

15. The method according to claim 9, wherein the step of providing a movable support includes:

providing a movable support positioned at least partly above the casting roller.

* * * * *